US006300777B1

(12) United States Patent
Ribarich

(10) Patent No.: US 6,300,777 B1
(45) Date of Patent: Oct. 9, 2001

(54) LAMP IGNITION DETECTION CIRCUIT

(75) Inventor: Thomas J. Ribarich, Laguna Beach, CA (US)

(73) Assignee: International Rectifier Corporation, El Segundo, CA (US)

( * ) Notice: Subject to any disclaimer, the term of this patent is extended or adjusted under 35 U.S.C. 154(b) by 0 days.

(21) Appl. No.: 09/139,743

(22) Filed: Aug. 25, 1998

Related U.S. Application Data

(60) Provisional application No. 60/061,848, filed on Oct. 15, 1997.

(51) Int. Cl.[7] ..... G01R 27/28; G01R 31/00

(52) U.S. Cl. ..... 324/652; 324/414

(58) Field of Search ..... 324/655, 656, 324/650, 652, 653, 654, 414, 403, 409; 315/291

(56) References Cited

U.S. PATENT DOCUMENTS

| | | | | |
|---|---|---|---|---|
| 5,225,783 | * | 7/1993 | Suzuki et al. | 324/655 |
| 5,331,253 | | 7/1994 | Counts | 315/209 R |
| 5,424,611 | | 6/1995 | Moriarty, Jr. | 315/94 |
| 5,471,119 | | 11/1995 | Ranganath et al. | 315/307 |
| 5,491,387 | | 2/1996 | Saito | 315/307 |
| 5,495,170 | * | 2/1996 | Feeney et al. | 324/655 |
| 5,525,872 | | 6/1996 | Achten et al. | 315/291 |
| 5,539,281 | | 7/1996 | Shackle et al. | 315/224 |
| 5,545,955 | | 8/1996 | Wood | 315/224 |
| 5,717,295 | | 2/1998 | Nerone | 315/307 |
| 5,719,472 | | 2/1998 | Kachmarik et al. | 315/224 |
| 5,729,096 | | 3/1998 | Liu et al. | 315/225 |
| 5,818,669 | | 10/1998 | Mader | 361/18 |

FOREIGN PATENT DOCUMENTS

| | | |
|---|---|---|
| 62-249398 | 10/1987 | (JP) . |
| 242396 | 3/1990 | (JP) . |
| 2199797 | 8/1990 | (JP) . |
| 2148595 | 12/1990 | (JP) . |
| 349187 | 3/1991 | (JP) . |
| 3156892 | 7/1991 | (JP) . |
| 3169265 | 7/1991 | (JP) . |
| 473893 | 3/1992 | (JP) . |

* cited by examiner

*Primary Examiner*—Safet Metjahic
*Assistant Examiner*—James C Kerveros
(74) *Attorney, Agent, or Firm*—Ostrolenk, Faber, Gerb & Soffen, LLP

(57) ABSTRACT

A circuit for detecting the ignition of a fluorescent lamp at any dim position by comparing the phase of the current flowing through the lamp resonant output stage to a predetermined reference phase value. When the phase of the current is coincident with the predetermined reference phase, lamp ignition has occurred and the circuit automatically "closes the loop" so that the lamp power can be regulated (via phase control) to a user designated setting. The phase of the lamp resonant circuit current is measured in the present invention by detecting the zero-crossing of the inductor current as measured across a resistor disposed in the lamp resonant circuit. The only way for the phase of the inductor current to reach the reference phase is if the lamp ignites (provided the frequency is above the resonance frequency and is ramping smoothly from a high frequency down to the ignition frequency). The circuit is designed to wait approximately 10 cycles to avoid closing the loop before the lamp has struck.

13 Claims, 6 Drawing Sheets

LAMP IGNITION DETECTION CIRCUIT

This application claims the benefit of U.S. Provisional Application Serial No. 60/061,848, filed on Oct. 15, 1997.

BACKGROUND OF THE INVENTION

An important feature of a dimmable electronic ballast is the ability to ignite the lamp at any dim position. It is difficult to determine when the lamp strikes, since lamp ignition is a function of filament pre-heating, temperature, frequency, distance to the nearest earth plane (usually the fixture) and age of the tube. If the regulation loop is not closed immediately after ignition (hundreds of microseconds), the result is an unwanted "flash" over the tube before going to the user dim setting (or lamp brightness setting).

In a conventional lamp resonant output stage, the frequency of operation at which the tube strikes is usually close to the maximum brightness operating frequency during running. Therefore, all present day fluorescent lamps are ignited close to 100% brightness. The travel time to a low brightness setting after ignition results in a "flash" seen by a user.

Furthermore, if a conventional lamp circuit falsely detects an ignition when the lamp has not yet ignited, the circuit will close the loop and regulate back out of ignition to somewhere between the ignition and preheat frequencies. This results in dangerously high voltages and currents across and through the tube and in the ballast output stage for an indefinite amount of time.

SUMMARY OF THE INVENTION

The present invention addresses the above-described problems by providing a circuit for detecting ignition of the lamp at any dim position.

The ignition detection circuit of the present invention detects the ignition of a fluorescent lamp by comparing the phase of the total lamp resonant circuit current to a predetermined reference phase value. When the phase of the total lamp resonant circuit current is coincident with the predetermined reference phase, lamp ignition has occurred and the circuit automatically "closes the loop" so that the lamp power can be regulated (via phase control) to a user designated setting.

The phase of the total lamp resonant circuit current is measured in the present invention by detecting the zero-crossing of the inductor current as measured across a resistor disposed in the lamp resonant circuit. The only way for the phase of the inductor current to reach the reference phase is if the lamp ignites (provided the frequency is above the resonance frequency and is ramping smoothly from a high frequency down to the ignition frequency).

The circuit of the present invention is advantageously designed to wait approximately 10 cycles to avoid closing the loop before the lamp has struck.

Other features and advantages of the present invention will become apparent from the following description of the invention which refers to the accompanying drawings.

DETAILED DESCRIPTION OF THE PREFERRED EMBODIMENT

Figure 1:
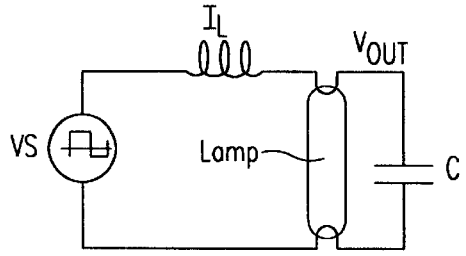
FIG. 1 shows a lamp resonant output circuit.

A typical lamp resonant output circuit is shown in FIG. 1. The term "total lamp resonant circuit current" as used herein means the total input current flowing into the ballast output stage ($I_L$ in FIG. 1). The ballast output stage is comprised of the half-bridge switches and DC blocking capacitor (as represented by voltage source $V_S$ in FIG. 1), the inductor L, the capacitor C, and the fluorescent lamp.

Figure 2:
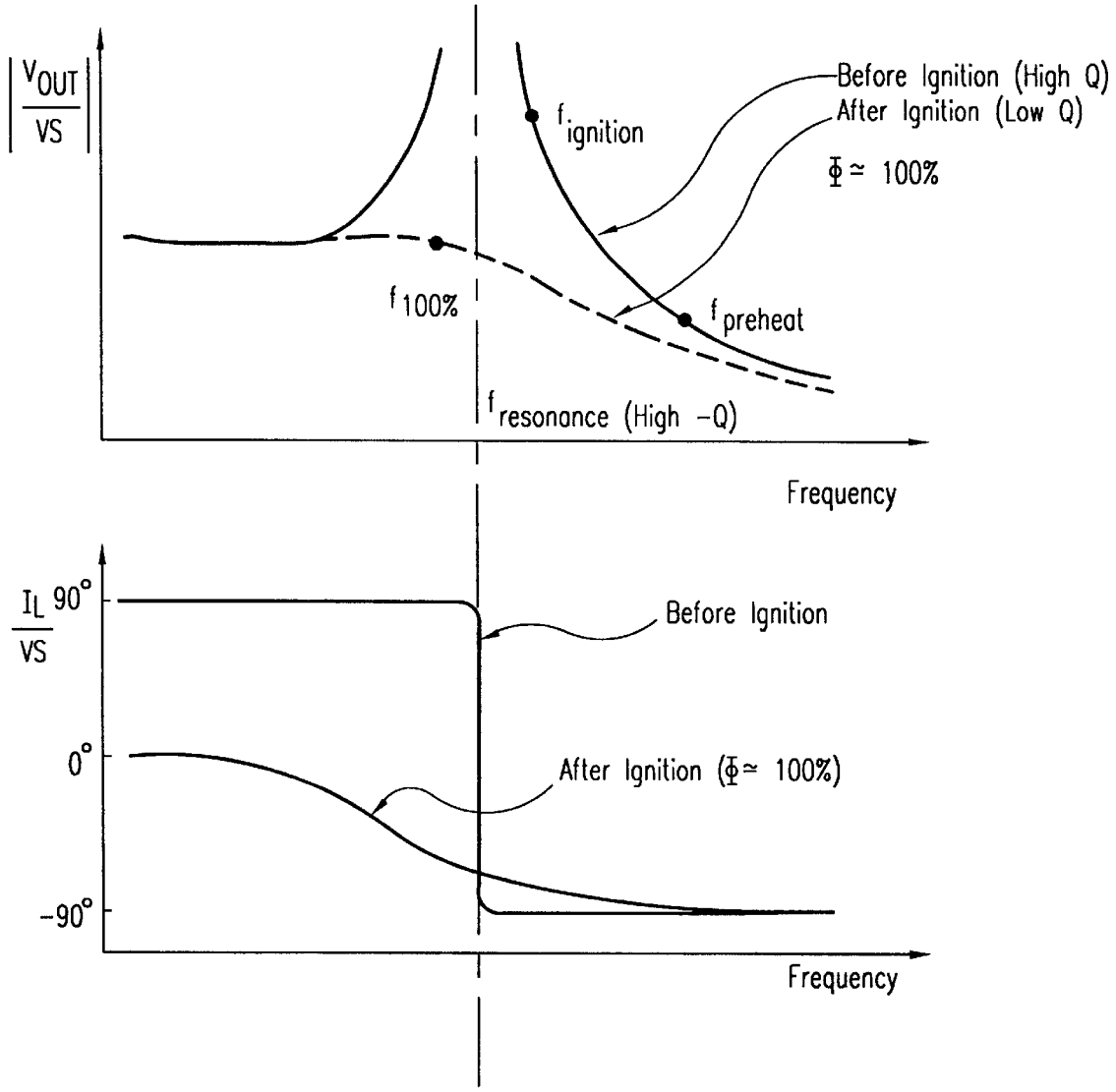
FIG. 2 is the Bode Diagram for the lamp resonant output circuit of FIG. 1.

The principle behind detecting a lamp ignition can be best understood by looking at a Bode Diagram of the input current to input voltage transfer function and phase for the lamp resonant output circuit. From the Bode Diagram, shown in FIG. 2, it can be seen that for the high-Q circuit (before the lamp has ignited), the phase of the total load current ($I_L$) with respect to the input voltage ($V_S$) has a strong inversion from +90° to −90° at the resonant frequency of the lamp resonant output circuit. At a typical gain along the transfer function ($V_{out}/V_S$) for achieving high voltages to strike the lamp, the phase of the load current remains constant at −90° shifted from the input voltage ($V_S$).

When the lamp strikes, the lamp resonant output circuit changes to a low-Q circuit due to damping by the arc established through the lamp. The phase now has a soft inversion and is shifted somewhere between 0° and −90° dependent upon the power in the lamp. By detecting this change in the phase of the total load current ($I_L$) with respect to the input voltage ($V_S$), lamp ignition can be detected and regulation to the user brightness setting can begin.

Figure 3:
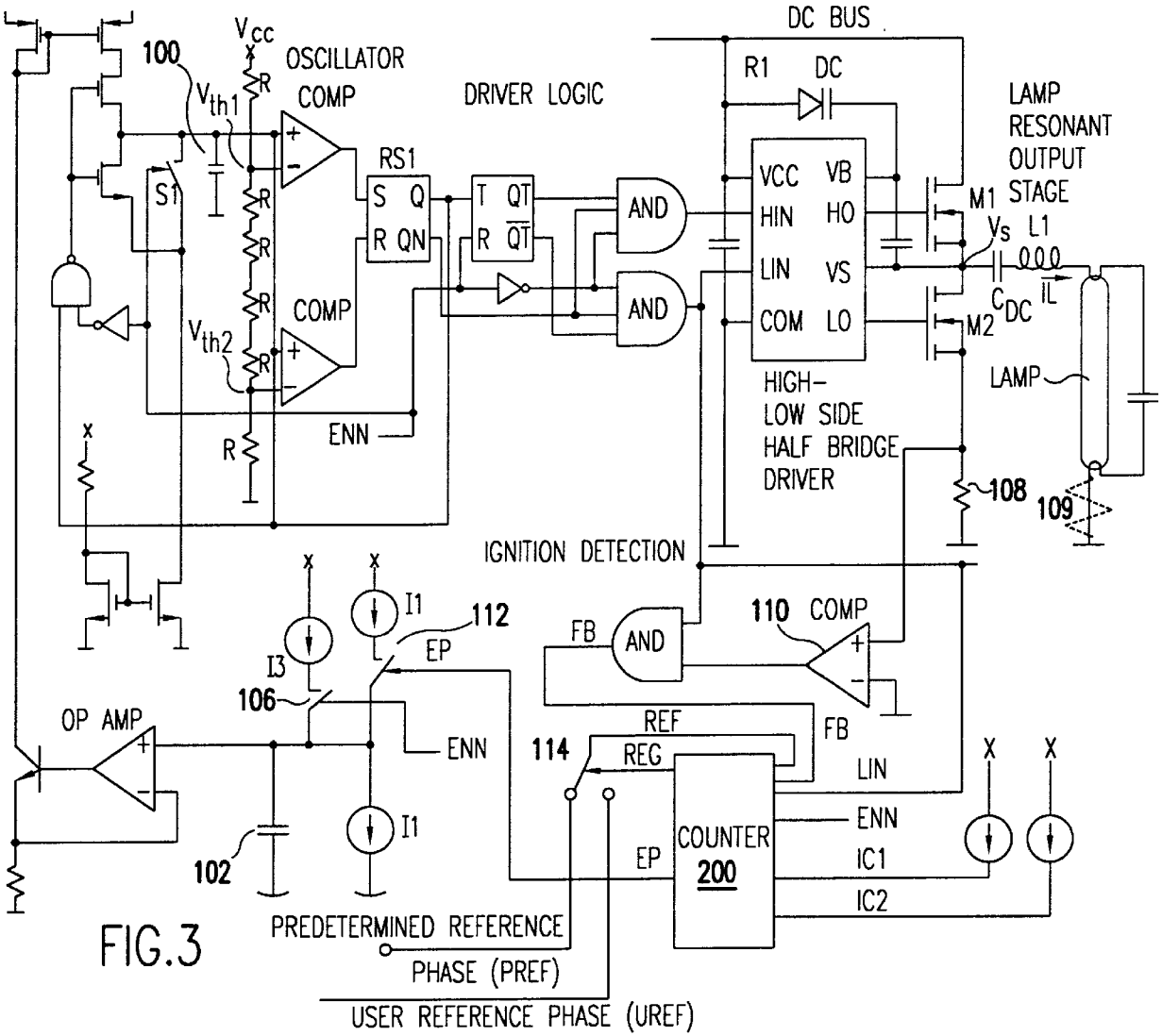
FIG. 3 shows the lamp ignition detection circuit of the present invention.

The ignition detection circuit of the present invention, shown in FIG. 3, measures the phase by detecting the zero-crossing of the inductor current $I_L$ and waits until it reaches a reference phase before closing the regulation loop. The only way for the phase of the inductor current to reach the reference phase is if the lamp ignites (provided the frequency is ramping smoothly from a high frequency down to the ignition frequency).

In the operation of the invention, initially, enable signal ENN is a logic "high" which disables the driver logic and oscillator and therefore keeps both half-bridge switches off (HO and LO are both logic "low"). When ENN goes low, capacitor 102 begins to charge and discharge between threshold voltages $V_{th1}$ and $V_{th2}$ at some frequency above the lamp ignition frequency determined by the initial condition voltage on capacitor 102. Before the circuit is enabled, ENN closes switch 106 and capacitor 102 is charged to an initial voltage through current source $I_3$. The phase of the load current $I_L$ is detected by a resistor 108 disposed between the lower half-bridge switch and ground. The resulting voltage across the resistor 108 is compared to ground voltage in comparator 110. It should be noted that the sensing resistor 108 can also be disposed between the lower lamp filament and ground as indicated by resistor 109 shown in dashed lines in FIG. 3. The voltage across resistor 108 is then synchronized with LIN through AND gate 112 to blank out any unwanted signals which can occur during the remainder of the switching period. If resistor 108 is disposed between the lower lamp filament and ground, then the output of comparator 110 should be synchronized with $H_{IN}$.

Figure 4:
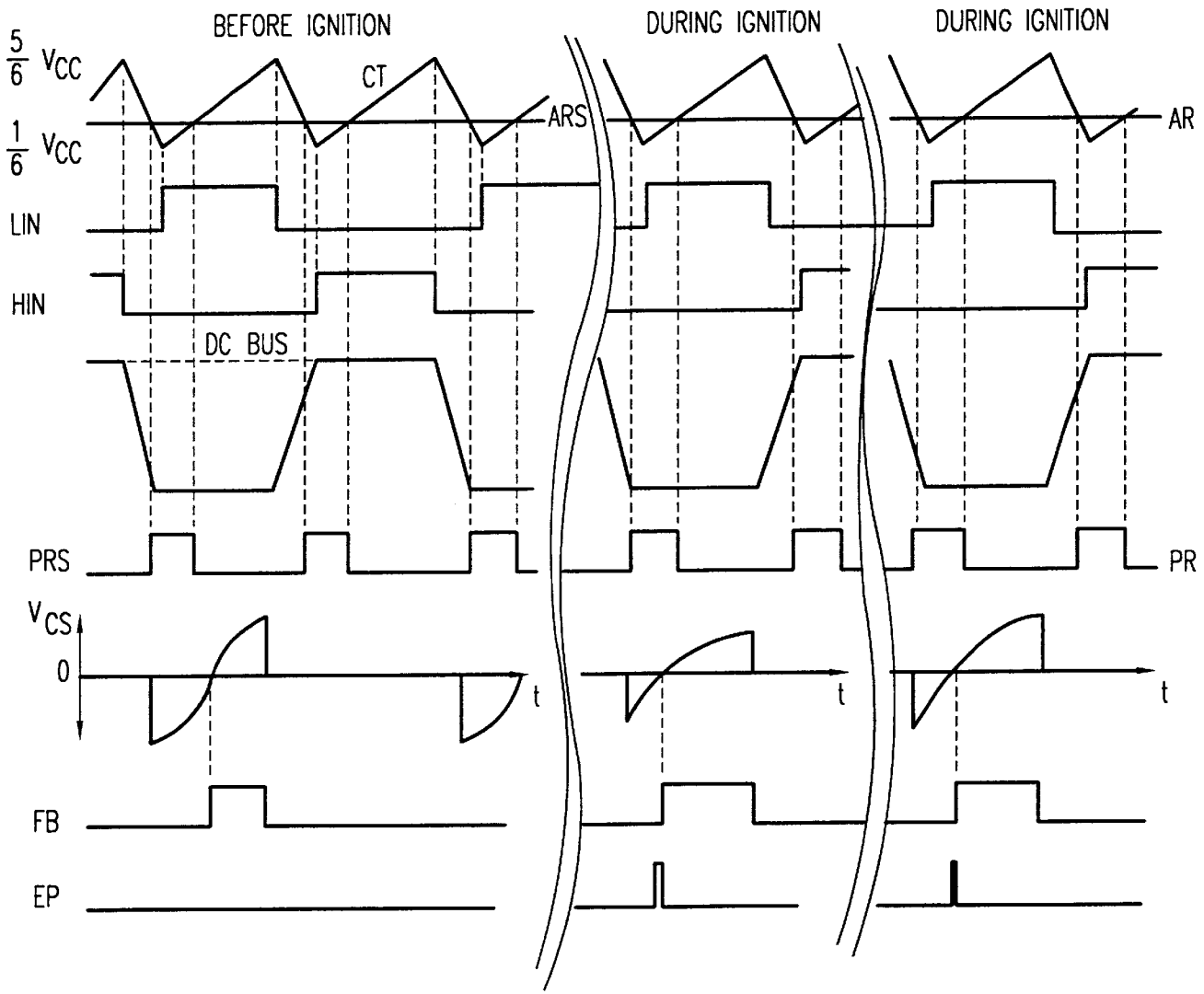
FIG. 4 is a timing diagram of the ignition detection circuit of the present invention.

As the voltage on capacitor 102 discharges through current source 121 the frequency decreases towards the resonant frequency of the high-Q lamp resonant output circuit and therefore towards the ignition frequency for the lamp. The phase of the load current remains −90° shifted from the input voltage $V_S$ (see timing diagram, FIG. 4). When the ignition frequency is reached, the lamp strikes and the phase shifts towards the reference phase (REF) as the lamp arc current begins to flow and the circuit becomes over-damped (low-Q). When phase (FB) is coincident with the reference phase (REF) (for about 10 cycles as described below), the output of comparator 220 (FIG. 5) goes logic high and the reference REF is switched from a predetermined value PREF (a safe margin away from −90°) to the user reference value UREF by control signal REG.

Figure 5:
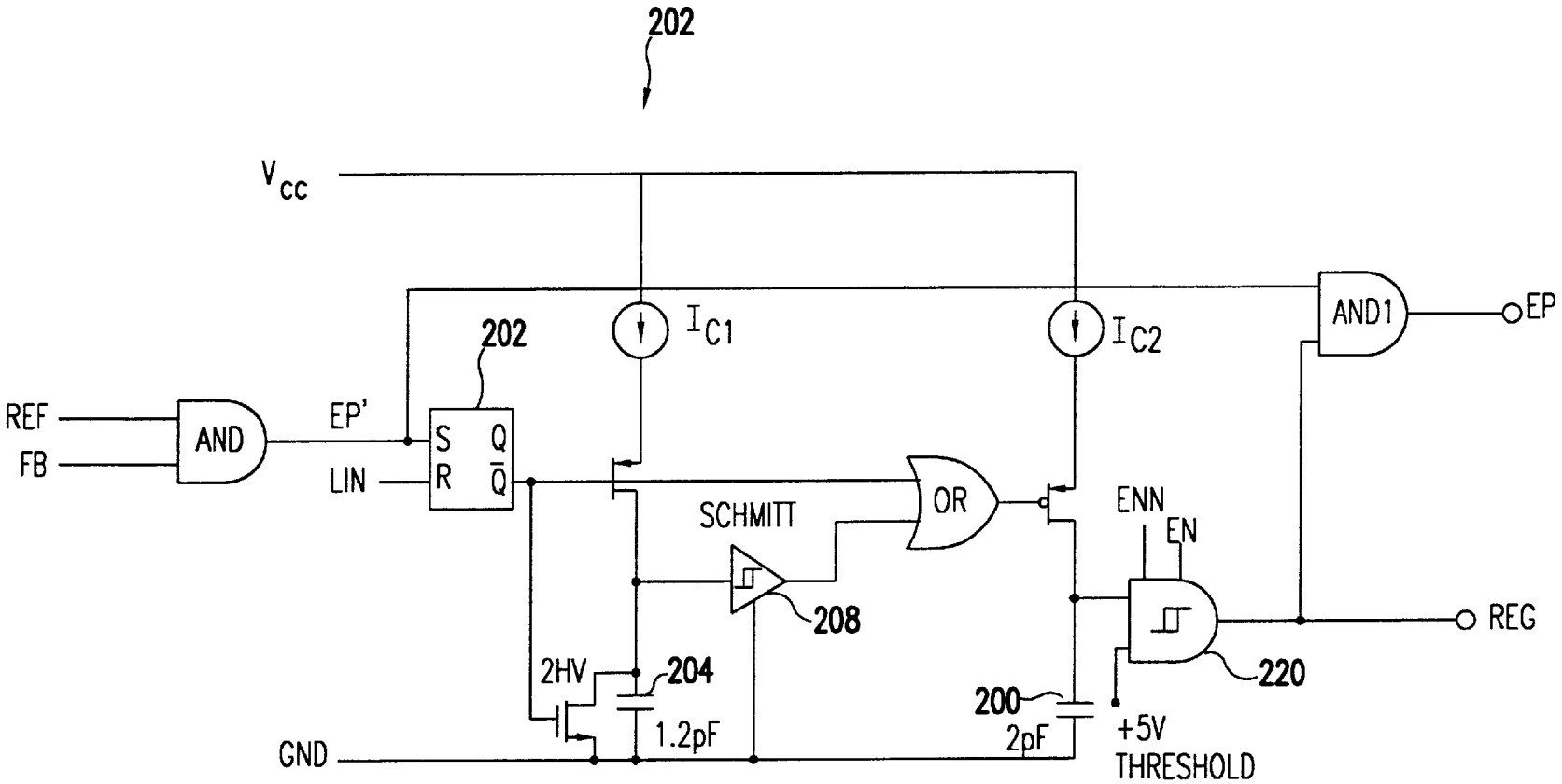
FIG. 5 is a circuit diagram for an integrated counter which counts a predetermined number of cycles of the phase exceeding a reference value before closing the loop.

The circuit is intentionally designed to wait approximately 10 cycles to avoid closing the loop before the lamp has struck (depending upon the initial condition of current in the LC tank, the voltage can bounce around zero a number of times just prior to ignition). In the preferred embodiment of the present invention, the circuit for waiting about 10 cycles of the phase hitting the reference value is an integrated counter 200 as shown in FIG. 5. The timing diagram for the counter is shown in FIG. 6.

Figure 6:
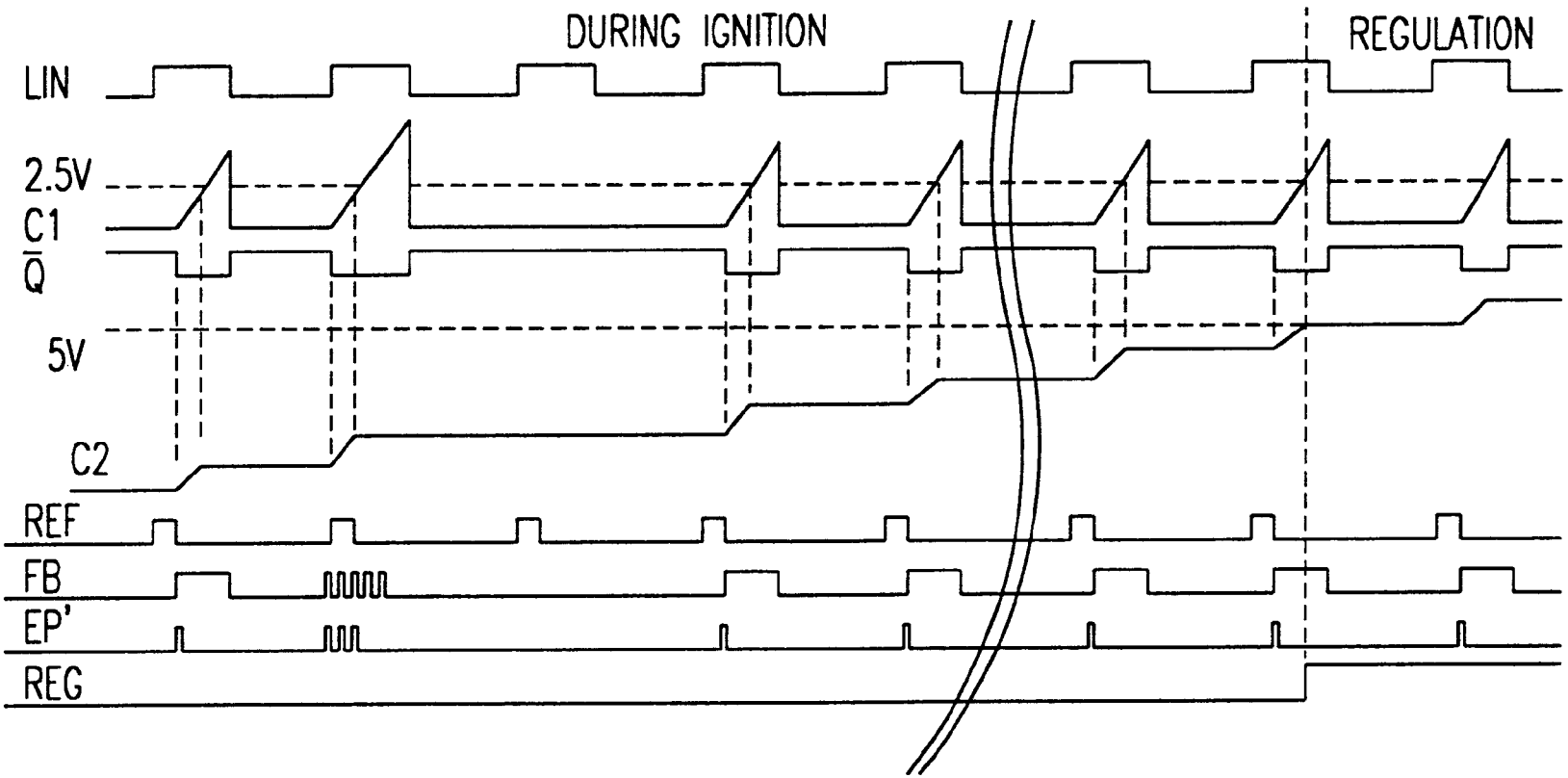
FIG. 6 is a timing diagram for the circuit of FIG. 5.

Referring to FIGS. 5 and 6, if EP' is high (indicating that the phase has reached the reference value; i.e., FB is coincident with REF), the RS latch 202 sets, allowing capacitors 204 and 206 to charge with short pulses of current. Capacitor 206 will charge so long as capacitor 204 does not charge to a voltage level which trips the Schmitt trigger 208 (2.5 volts in the preferred embodiment). At such time, capacitor 206 stops charging and, when LIN goes low, the latch is reset and capacitor 204 is discharged. When LIN goes high again and FB is coincident with REF, the latch is set again and capacitor 204 begins charging again, allowing capacitor 206 to continue charging again until capacitor 204 exceeds a voltage which trips Schmitt trigger 208. This process continues until capacitor 206 has reached a predetermined voltage level, e.g. 5 volts in the preferred embodiment of the invention, which corresponds to about 10 cycles of LIN.

Figure 7:
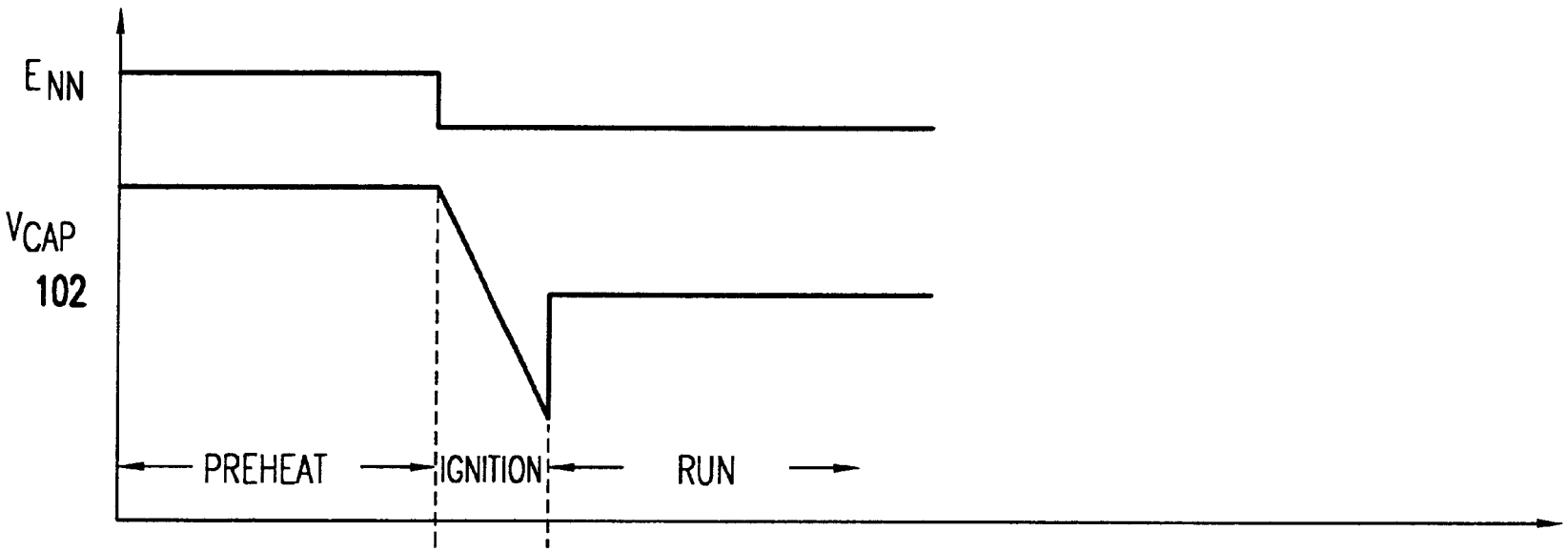
FIG. 7 is a timing diagram of the VCO control voltage.

When capacitor 206 reaches the predetermined voltage level, comparator 220 is set, REG is enabled, EP is enabled, and the loop is closed via switches 112 and 114. the frequency increases as the voltage across capacitor 102 is charged by current source $I_1$ (FIG. 7) until FB slightly lags PREF and EP goes "low." As the frequency tries to decrease again through $1_2$, EP "nudgees" the frequency back up, regulating FB against PREF and therefore the lamp brightness against the user brightness reference (UREF).

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. A circuit for detecting ignition of a fluorescent lamp disposed in an integrated lamp resonant circuit and driven by a pair of switches disposed in a half-bridge arrangement for supplying power to the fluorescent lamp, the half bridge arrangement of the pair of switches supplying an oscillating input voltage to the lamp resonant circuit, the resonant circuit having a current flowing therethrough, the current flowing through said resonant circuit having a phase, the circuit comprising:

means for determining the phase of the total current flowing through the lamp resonant circuit;

means for comparing the phase of the total lamp resonant circuit current to a predetermined reference phase value and for detecting when the phase of the total lamp resonant circuit current is coincident with the predetermined reference phase, signifying that lamp ignition has occurred; and means for closing a feedback loop to regulate the phase of the total lamp resonant circuit current in accordance with a user defined reference setting when lamp ignition is detected.

2. A circuit as recited in claim 1, wherein the means for determining the phase of the total lamp resonant circuit current comprises means for detecting the zero-crossing of the total lamp resonant circuit current.

3. A circuit as recited in claim 2, wherein the zero-crossing of the total lamp resonant circuit current is detected by measuring the voltage across a resistor disposed in the lamp resonant circuit and comparing the voltage to ground voltage.

4. A circuit as recited in claim 3, wherein the pair of switches disposed in a half-bridge arrangement comprise upper and lower switches, and the resistor is disposed between the lower switch and ground.

5. A circuit as recited in claim 3, wherein of the resistor is disposed between a lower filament of the fluorescent lamp and ground.

6. A circuit as recited in claim 1, further comprising means for waiting a predetermined number of cycles of operating frequency in which the total lamp resonant circuit current phase is coincident with the reference phase before closing the feedback loop to avoid closing the loop before the lamp has struck.

7. A circuit as recited in claim 6, wherein said means for waiting a predetermined number of cycles comprises an integrated counter.

8. A method for detecting ignition of a fluorescent lamp disposed in an integrated lamp resonant circuit and driven by a pair of switches disposed in a half-bridge arrangement for supplying power to the fluorescent lamp, the half bridge arrangement of the pair of switches supplying an oscillating input voltage to the lamp resonant circuit, the resonant circuit having a current flowing therethrough, the current flowing through said resonant circuit having a phase, the method comprising the steps of:

determining the phase of the total current flowing through lamp resonant circuit;

comparing the phase of the total lamp resonant circuit current to a predetermined reference phase value and detecting when the phase of the total lamp resonant circuit current is coincident with the predetermined reference phase, signifying that lamp ignition has occurred; and closing a feedback loop to regulate the phase of the total lamp resonant circuit current in accordance with a user defined reference setting when lamp ignition is detected.

9. A method as recited in claim 8, wherein the phase of the total lamp resonant circuit current is determined by detecting the zero-crossing of the total lamp resonant circuit current.

10. A method as recited in claim 9, wherein the zero-crossing of the total lamp resonant circuit current is detected by measuring the voltage across a resistor disposed in the lamp resonant circuit and comparing the voltage to ground voltage.

11. A method as recited in claim 10, wherein the pair of switches disposed in a half-bridge arrangement comprise upper and lower switches, and the resistor is disposed between the lower switch and ground.

12. A method as recited in claim 10, wherein of the resistor is disposed between a lower filament of the fluorescent lamp and ground.

13. A method as recited in claim 8, further comprising the step of waiting a predetermined number of cycles of operating frequency in which the total lamp resonant circuit current phase is coincident with the reference phase before closing the feedback loop to avoid closing the loop before the lamp has struck.

* * * * *